US009458635B1

(12) United States Patent
Anic

(10) Patent No.: US 9,458,635 B1
(45) Date of Patent: Oct. 4, 2016

(54) STRINGER FOR DECKING

(71) Applicant: Jeffrey Sargen, York, PA (US)

(72) Inventor: Miro Anic, Mechanicsburg, PA (US)

(73) Assignee: Jeffrey Sargen, York, PA (US)

( * ) Notice: Subject to any disclaimer, the term of this patent is extended or adjusted under 35 U.S.C. 154(b) by 0 days.

(21) Appl. No.: 14/860,828

(22) Filed: Sep. 22, 2015

(51) Int. Cl.

| | |
|---|---|
| ***E04F 15/00*** | (2006.01) |
| ***E04F 15/02*** | (2006.01) |
| ***E04C 3/02*** | (2006.01) |
| ***E04B 5/02*** | (2006.01) |

(52) U.S. Cl.
CPC ..... *E04F 15/02183* (2013.01); *E04B 5/023* (2013.01); *E04C 3/02* (2013.01); *E04F 15/02044* (2013.01); *E04F 15/02166* (2013.01)

(58) Field of Classification Search
CPC ..... E04B 2002/7475; E04D 3/3605; E04F 15/04; E04F 15/02044; E04F 15/20; E04F 15/02038; E04F 15/02133
USPC ..... 52/172, 480, 483.1, 489.1, 489.2, 52/745.13
See application file for complete search history.

(56) References Cited

U.S. PATENT DOCUMENTS

| | | | | |
|---|---|---|---|---|
| 6,510,621 | B2 | 1/2003 | Camara et al. | |
| 7,461,492 | B1 | 12/2008 | Francies, III et al. | |
| 7,571,580 | B2 * | 8/2009 | Miller | 52/650.3 |
| 7,874,113 | B2 * | 1/2011 | Eberle, III | 52/403.1 |
| 8,146,303 | B2 * | 4/2012 | Gibson et al. | 52/177 |
| 8,544,229 | B2 * | 10/2013 | Kilgore et al. | 52/489.2 |
| 8,672,600 | B2 * | 3/2014 | Reznar et al. | 411/457 |
| 9,127,466 | B2 * | 9/2015 | Hinkle | |
| 9,181,716 | B1 * | 11/2015 | Gibson | |
| 2005/0257473 | A1 * | 11/2005 | Shaw et al. | 52/480 |
| 2010/0146900 | A1 * | 6/2010 | Holland | 52/650.3 |
| 2014/0215944 | A1 | 8/2014 | Husler | |

OTHER PUBLICATIONS

Home Depot, Black NBM Biscuit Style Hidden Deck Fastener with Pre-Set Trim Head Screws, http://www.homedepot.com/p/Unbranded-Black-NMB-Biscuit-Style-Hidden-Deck-Fastener, Jun. 25, 2015, 1 page.
Veranda, Veranda Armorguard Decking, http//www.verandadeck.com/products/cornposite-decking/armorguard/, Jun. 25, 2015, 11 pages.

* cited by examiner

*Primary Examiner* — James Buckle, Jr.
(74) *Attorney, Agent, or Firm* — Drinker Biddle & Reath LLP

(57) ABSTRACT

A stringer for decking has a strip of material to extend over a top surface of a decking joist, and is provided with clips. Each clip has a base part standing up from the strip, and a head projecting in the lengthwise direction of the strip. Alternate clips have their heads projecting towards opposite ends of the joist. The size of the head, and the height of the head above the strip, are chosen to fit into the grooves of a standard grooved deck board. The lengthwise spacing between two adjacent clips with their heads facing towards each other is chosen so that the standard grooved deck board will fit onto the two clips with the two heads received in the grooves on either side of the board. The lengthwise spacing between two adjacent clips with their heads facing away from each other sets the width of a gap between two boards fitted onto the two clips.

8 Claims, 2 Drawing Sheets

STRINGER FOR DECKING

FIELD OF THE INVENTION

The present application relates to decking. Decking typically consists of level (approximately horizontal) planks or boards, laid across supporting joists, to form a surface on which people can walk and place furniture. The decking is commonly placed out of doors, either in a yard area near to an inhabited building, or over a weather-resisting but not walkable roof area.

BACKGROUND

Traditional decking consists essentially of wooden joists mounted on some sort of sub-frame, across which are laid wooden boards. The boards are usually slightly spaced apart, to allow rain to drain away between them. The boards are fastened in place by nails or screws passing through the boards and into the joists. Positioning the boards at the correct spacing, and evenly spaced so as to give a pleasing effect to the eye and to line up with the opposite edges of the deck, requires both skill and much time. Also, the screw heads visible in the surface of the boards are not pleasing to some people. More recently, synthetic or composite materials have been used for the boards in place of wood, but those do not affect the above-mentioned disadvantages.

U.S. Pat. No. 6,510,621 to Camara et al. describes a system for spacing the boards of a deck. A strap is provided that has bars projecting from it at regular intervals. Several boards are laid loosely on the joists, and the strap is drawn tight with the spacer bars projecting down between the boards. That spaces the boards correctly, and they are then screwed into place in the old way. This is still very labor intensive and slow, and manipulating both the straps and several loose boards at the same time may not be easy for the inexperienced installer. Also, buying the straps, which are a reusable tool, may not be attractive for a homeowner who will only use them once.

Deck boards, wooden or composite, are also available with a groove or kerf along the narrow sides, which are the upright sides when the board is installed. These boards are used in combination with clips that fit between the boards. In one commercially available product, each clip has two wings that fit into the kerfs of the adjacent boards, and a middle part that sets the spacing between the boards. Each clip is set against the previous board, and fastened to the joists by a narrow-headed screw through the body of the clip. The next board is then set against the clip. These clips assist in spacing the boards evenly, and have the advantage that they are almost invisible when the deck is complete. However, installation may not be easy. Each screw must initially be set with the clip accurately held against the side of the previous board. Then, to ensure secure fastening, the screw must be tightened after both boards are in place. The screw head is at that stage in the gap between the boards, so the upper parts of the boards may foul the screwdriver. Removing a board may be possible, provided that the screw heads can be reached with a screwdriver, but would typically require loosening at least one board adjacent to the one being removed.

US 2014/0215944 to Husler describes a mounting system using connectors that extend along the boards. Similarly to the clips just mentioned, each connector has two wings that fit into the kerfs of the adjacent boards, and a middle part that sets the spacing between the boards. Each clip is set against the previous board, and fastened to the joists by a screw or nail through a bottom flange of the connector. The next board is then set against the clip. These connectors assist in spacing the boards evenly, and have the advantage that they are almost invisible when the deck is complete. However, care is still required to ensure that the connectors and boards are positioned snugly against one another, and it is not easy to replace a board in the middle of the deck, because the connectors cannot readily be released.

There is therefore still a need for better ways of installing deck boarding.

SUMMARY

According to one aspect, there is provided a stringer with a strip of material having a lengthwise direction to extend along a top surface of a decking joist, and a widthwise direction to extend across the top surface of the decking joist, and clips. Each clip has a base part standing up from the strip, and a head projecting in the lengthwise direction of the strip. Alternate clips have their heads projecting in opposite directions. The size of the head, and the height of the head above the strip, are preferably chosen to fit into a standard grooved deck board. The lengthwise spacing between two adjacent clips with their heads facing towards each other is preferably chosen so that a standard grooved deck board will fit onto the two clips with the two heads received in the grooves on either side of the board. The lengthwise spacing between two adjacent clips with their heads facing away from each other is preferably chosen to set the spacing between two boards fitted onto the two clips.

The stringer may be of any desired length, and preferably contains clips for several adjacent boards. The stringer then provides easy and reliable placement of the boards at the correct spacing, as determined by the spacing between the clips.

The clips may be offset from the longitudinal centerline of the stringer, so that the clips with heads facing in the two directions form two rows, on either side of the centerline.

The strip may have flanges extending downwards along its side edges, to fit over the sides of the joist.

The strip may be of metal, and the clips may then be formed by cutting flaps out of the metal strip, and bending the flaps to form the clips. Alternatively, the clips may be separate pieces of metal spot welded onto the strip. Alternatively, the stringer may be of plastic, for example, PVC, and the clips may be formed and/or attached in any convenient way.

Holes for nailing or screwing the stringer to the joist may be provided between pairs of clips with their heads facing towards each other, where the nails or screws will be hidden under the boards.

DETAILED DESCRIPTION

Figure 1:
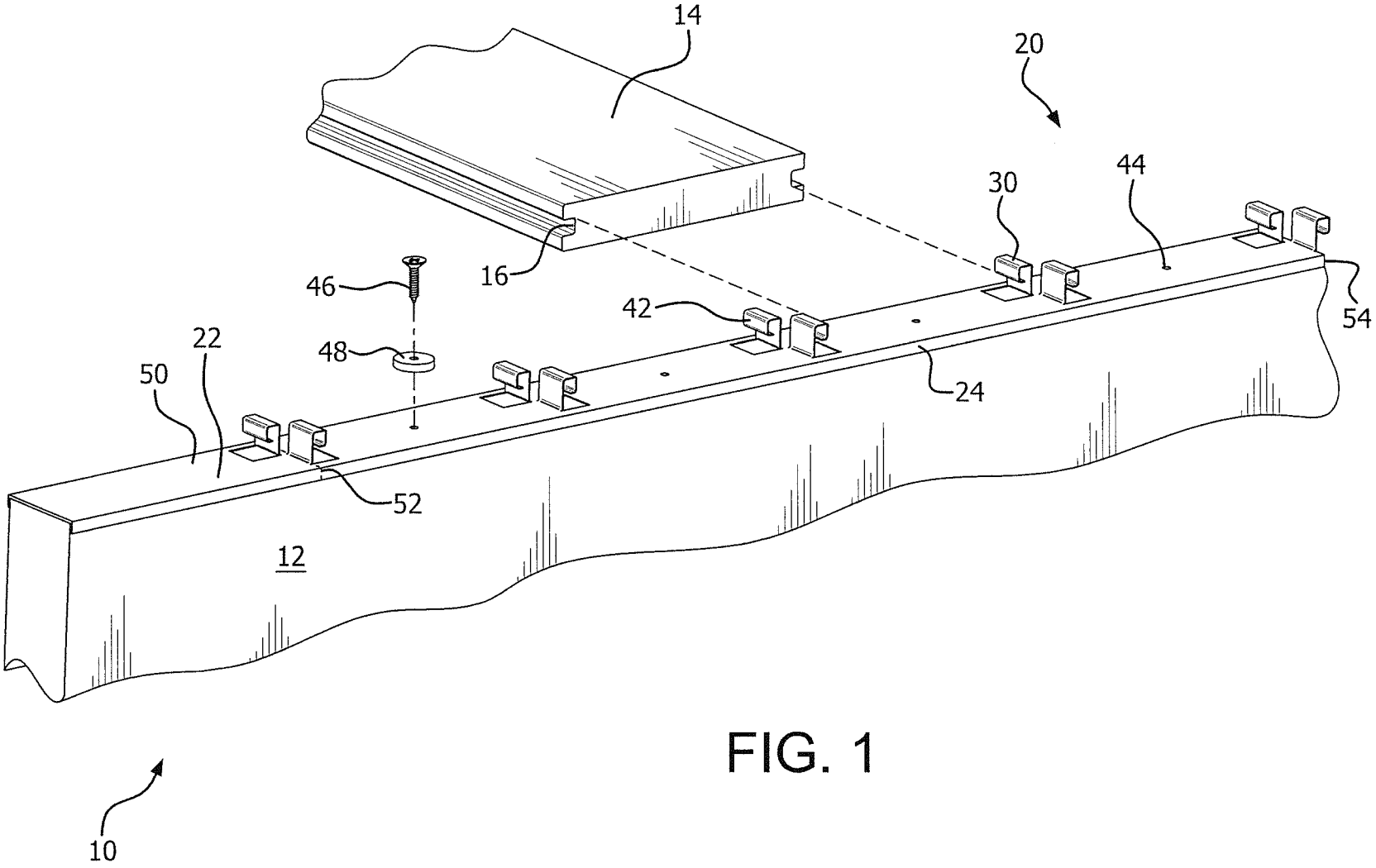
FIG. 1 is a perspective view of part of a deck including an embodiment of a stringer.

Referring to the accompanying drawings, a deck indicated generally by the reference numeral 10, only part of which is shown in FIG. 1, includes joists 12, laid generally parallel to one another. The joists 12 may be conventional, and may consist of wood beams nominally 8"×2" (200 mm×50 mm), with a narrow side uppermost. The joists 12 are mounted on a sub-frame, which may be conventional and in the interests of simplicity is not shown. Boards 14 are laid across the joists 12 to form the deck. The boards may be conventional, and may be wood or composite decking boards with a nominal width of 6" (150 mm), actual width approximately 5½" (135 mm) and a nominal thickness of just under 1" (25 mm). The boards 14 have grooves 16 in their narrow sides.

A stringer indicated generally by the reference numeral 20 is laid along the top of each joist 12. The stringer 20 comprises a strip 22 of aluminum or galvanized steel as wide as the joist 12, with flanges 24 along both side edges that fit over the sides of the joist, and help to prevent the stringer 20 from shifting sideways out of its correct position. The metal cap formed by the strip 22 and flanges 24 over the top of the joist 12 can also provide significant weather protection for the joist.

Figure 2:
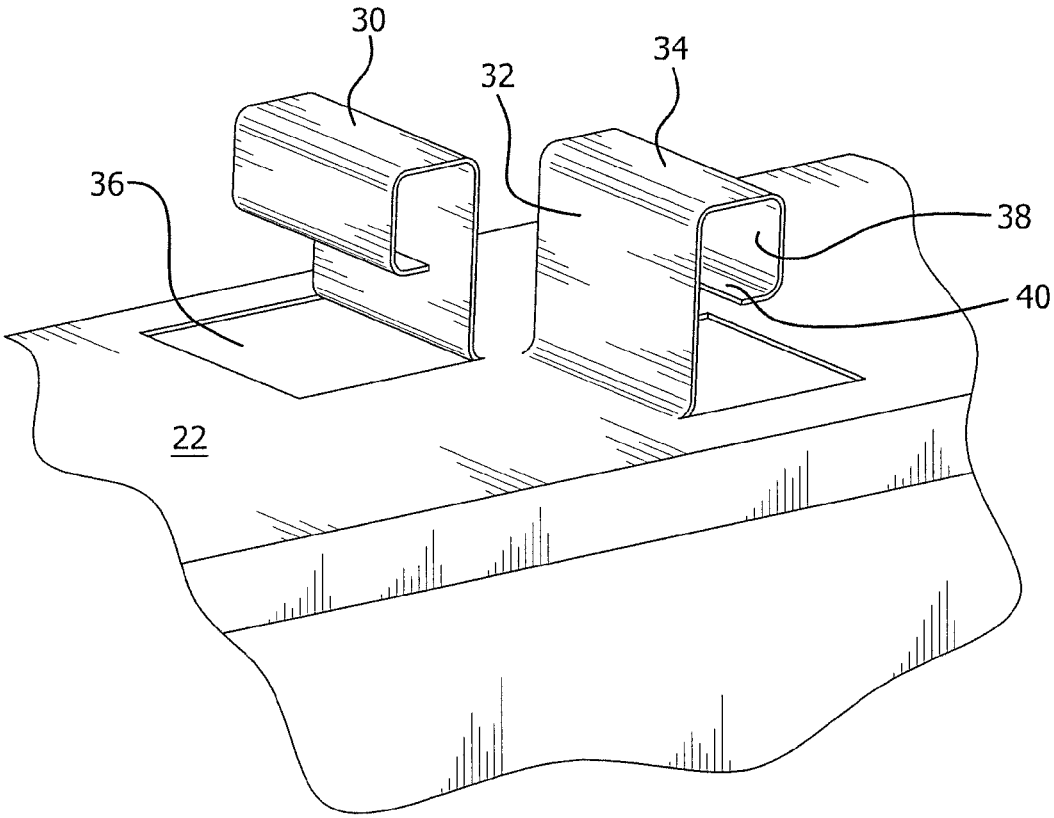
FIG. 2 is a detail of part of the stringer shown in FIG. 1.
Figure 3:
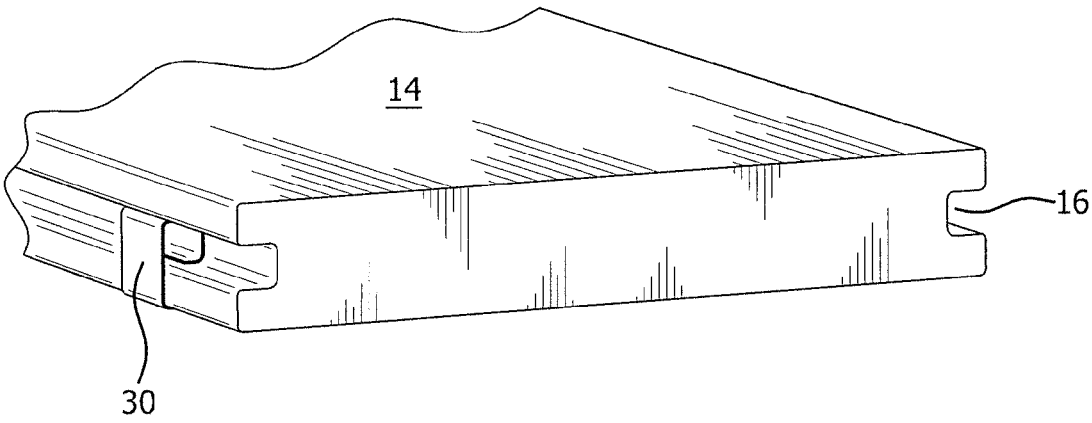
FIG. 3 is a detail of a clip and a board of the deck of FIG. 1.

The stringer 20 is provided on its top face with two rows of clips 30, best seen in FIG. 2. Each clip 30 consists of a flap of metal cut out of the strip 22 along three sides of a rectangle, and formed into an upstanding back 32, a top 34 projecting forwards from the top of the back 32 over the opening 36 left by cutting out the flap, a front 38 extending down from the front edge of the top 34, and a lip 40 extending back from the bottom edge of the front 38. The head 42 formed by the top 34, front 38, and lip 40 is sized to fit snugly into the groove 16 in a board 14. The height of the head 42 above the top of the strip 22 may be equal to or slightly greater than the height of the groove 16 above the bottom of the board 14.

In each of the two rows of clips 30, the heads 42 of all the clips face towards one and the same end of the stringer 30, which is the opposite end from the clips in the other row. As may be seen from FIG. 1, the two rows of clips 30 are staggered. Adjacent clips 30 with their heads facing towards each other are spaced apart so that the board 14 will fit between the backs 32 of the clips 30 when the heads 42 of the clips are in the grooves 16 of the board 14. Adjacent clips 30 with their backs towards each other are spaced apart lengthwise of the stringer 20 by the desired spacing between the boards 14, for example, ¼" (6 mm). Thus, as may be seen from FIG. 1, each clip 30, except the endmost ones, is adjacent head-to-head with a clip in one direction from it, and back-to-back with a clip in the other direction from it. Thus, a continuous chain of spaces, alternately spaces to receive boards 14 and spaces between boards, is formed along the length of the stringer 20.

As shown in FIG. 1, the two rows of clips 30, one row along each side of the stringer 20, are spaced apart in the side-to-side direction so that there is a continuous open lane, and therefore a continuous band of metal, down the middle of the stringer 20 between the two rows of clips 30. That is believed to provide a stronger structure than positioning pairs of clips 30 directly back to back, with only a ¼" (6 mm) wide ribbon of metal attaching them to the body of the strip 22 at its ends.

As shown in FIG. 1, the endmost clip 30 at each end of the stringer 20 is spaced from the end of the strip 22 by a section 50 equal in length to the width of a board. Then, the stringers 20 can easily be aligned by butting the end of the stringer up against a wall or other surface against which the side of the first board 14 will be butted up. A clip 30 may not be needed against the wall if, for example, the first board 30 is trapped under a siding J-channel or similar.

If a clip 30 is desired on the outer side of the first board 14, which will depend on the specific installation, then the end of the stringer 20 can be terminated just behind the first outward-facing clip 30, at the position shown by the broken line 52 in FIG. 1. The metal of the stringer 20 is typically thin enough to be cut quickly and easily with tin-snips or similar. However, in order to avoid leaving that endmost clip 30 with no support, it is recommended to cut away only the flanges 24 from the line 52, and fold the strip 22 back under itself along the line 52.

Screw or nail holes 44 are formed in the strip 22, midway between the clips where the holes 44 will be hidden under the planks 30.

In use, the framing of the deck is assembled up to and including the joists 12. A stringer 20 is cut to length, if necessary, and positioned on the top of each joist 12, with the flanges 24 over the sides of the joist. If the joists 12 are of pressure-treated lumber that may corrode the metal stringers 20, then isolation tape may be laid along the joists, or the undersides of the stringers may be provided with isolation tape or an isolation coating already applied. If tape is used, and the tape is continuous over the holes 36 left by raising the clips 30, then the weather protection of the top surface of the underlying joist 12 is almost complete.

The stringers 20 are preferably provided in a range of standard lengths, so that they can be cut to length without unnecessary waste. The stringers are aligned at one end. Usually, the deck framing or an adjacent building wall will provide a fairly accurate reference, but a snapped chalk line or similar may be marked for better precision. The installer should ensure that the clips form straight rows across the joists.

If the joists are longer than the longest available stringers, then two or more stringers 20 may be laid end-to-end on one joist 12. If, as mentioned above, one end of each stringer has an end section 50 equal in width to one board, then the other end may be cut off just outside the back 32 of the last end-facing clip 30, as shown at 54 in FIG. 1, leaving the clip attached to the stringer, so that with the two stringers 20 abutting end to end, the correct spacing between clips 30 is maintained.

Also, if the stringers 20 are cut to the length of the area to be covered by uniformly spaced boards 14, the stringers 20 can be combined with existing clips for custom framing, for example, where a board in a different orientation is used along an edge of the deck.

The stringers 20 are then fastened to the joists 20 by screws or nails 46 through the holes 44. The screws or nails 46 are preferably provided with large washers 48 of rubber or soft plastic, to provide cushioning for the boards 14, and to accommodate any slight unevenness in the stringers 20, such as might result from unevenness in the wooden joists 12. If washers 48 are to be used, then the heads 42 of the clips 30 may be slightly higher than the height of the groove 16 above the bottom of the board 14, to allow for the compressed thickness of the washer 48. It is desirable for the assembled deck to have the washers 48 slightly compressed, and the clips 30 under slight tension, so that the boards 14 do not rattle or shift in use, even if they distort slightly over time. Even if the boards 14 do become slightly loose, the washers 48 also avoid the risk of an audible bump when a person steps on a loose board 14 and the board strikes the joist 12 below it. If washers 48 are not used, then, depending on how much elastic movement is provided by the clips 30, it may be desirable for the heads 42 of the clips 30 to be slightly lower, so that there is still a downward pressure on the installed boards to hold the boards firmly in place.

If a screw 46 is inserted into every hole 44, then the total number of screws may be comparable to that used with conventional decking, or the previously proposed types of clip. However, the installation can be much quicker and easier, because the positions of the screws 46 are fixed by the stringers 20 with the preformed holes 44, rather than the installer having to set the screws in exact positions in order to fix the correct positions of the boards. Also, because the screws 46 will be hidden under the boards 14, it is no longer necessary to achieve a visually perfectly uniform setting of the screws, and because the screw heads will set against the metal of the stringer 20, rather than against wood or plastic, it is easier to set the heights of the screws evenly.

The boards 14 are then inserted into the clips 30. If the length of the top 34 of the clip 30 is no larger than the gap between clips with their backs 32 facing, then the boards can be inserted vertically downwards, as shown by the arrows in FIG. 1, in any order, because the clips 30 can spring back into the gaps and then snap forwards into the grooves 16. It is not necessary for the angle between the top 34 and the front 38 of the clip 30 to be beveled, because standard deck boards, especially composite boards, typically have generously rounded corners.

It may then also be possible to remove a board 14 from the middle of an assembled deck 10, by lifting it vertically upwards, and insert a replacement board in the same way. That is advantageous if, for example, a damaged board 14 needs to be replaced. It may be acceptable to destroy the damaged board in order to remove it, for example, by sawing it down the middle or by splitting off with a chisel the tongues above and below one of the grooves 16, but the replacement board needs to be inserted undamaged.

If the clips 30 extend deeper into the grooves 16, then the boards 14 are laid in order from one side. Each board is slid sideways onto the heads 42 of the clips 30 on the side nearer to the previous board 14, and the clips 30 on the other side can then be sprung back into the space not yet occupied by the next board, to allow the present board to be snapped into place.

It may then still be possible to remove a board 14 from the middle of an assembled deck 10, and insert a replacement board, by pushing the board 14 pushed sideways until it abuts the adjacent board on one side. The clips 30 on the other side can then be sprung out of or into the groove 16 one at a time with a flat-bladed screwdriver. That accommodates clips 30 that extend into the grooves 16 by up to twice the gap between boards.

Alternatively, if one end of the relevant board 14 is exposed at an edge of the deck, it may be possible to slide the old board out and the replacement board in endways. When sliding the new board in, typically the installer will compress each clip 30 to ensure that it enters the groove 16 cleanly. That process is made easier by the staggered arrangement of the clips 30, so that the installer is always feeding only one clip at a time into its groove, and not two at a time.

In an alternative sequence of assembly, the stringers 20 may be mounted on at least two or three of the joists 12 at an early stage in deck construction, before the framing is completed. Those stringers 20 then act as a ruler, showing the constructor how the boards will eventually be positioned. It may then be possible to adjust the framing, Although specific embodiments have been described, those skilled in the art will see that various modifications may be made without departing from the spirit or scope of the invention as defined by the appended claims.

As shown in the drawings, the stringers 20 are folded from aluminum or galvanized steel sheet, with the clips 30 folded from tabs cut out from the sheet on three sides, leaving openings 36. Other arrangements are of course possible. For example, the clips 30 could be separate pieces spot-welded or otherwise attached, avoiding the openings 36. That would be a stronger construction, though less economical. For another example, the lip 40 of the clips 30 could be omitted, which would simplify the folding process, by allowing a one-piece shaping punch to come up through the opening 36 from below to form the clip in cooperation with a one-piece top die. A molded or formed plastic stringer could similarly be produced with a simple two-piece die.

The length of the stringers 20 is not restricted. A commercial stock may contain stringers 20 of a range of standard lengths. In the United States of America (USA), those are typically multiples of two feet (approximately 600 mm), so a supplier might, for example, stock lengths of 6, 8, 10, and 16 feet. In the USA, the boards are typically about 5½ inches (140 mm) wide, and are set with a ¼ inch (6 mm) spacing, so a 6 foot long stringer would have just over 20 clips. In the interests of clarity, FIG. 1 has been simplified, and shows the stringer shortened to fit on the page. FIG. 1 should be understood as having the middle part of the joist and stringer repeated as necessary to provide a stringer of a desired length.

As described above and as shown in FIG. 1, the second end 54 of each stringer is cut off just outside the back 32 of the last end-facing clip 30, leaving the last clip 30 overhanging the end of the stringer. If it is preferred to manufacture the stringer 20 in a standard length that is not an exact multiple of the board pitch (board width plus gap between boards), that will not occur. However, the when two stringers 20 are to be placed abutting end to end, the second end 54 of one stringer can be cut off by the installer just outside an end-facing clip 30, at the position corresponding to the end 54 in FIG. 1, so that the correct spacing between clips 30 is maintained. Alternatively, or if custom framing results in a staggered arrangement of the stringers 20, a piece of board 14 may be used as a gauge to ensure that the spacing between the clips 30 is correct at the joint or gap between the two stringers 20.

Provided that the configuration and spacing of the clips 30 are consistent, the various sizes of component can be made interchangeable. It is then possible to mix stringers 20 of different lengths on one deck, which can lead to less custom cutting and more efficient use of the material.

Various dimensions and numerical values have been given for various components of the decking system shown in the drawings. Unless specifically indicated as essential, these dimensions and numbers are only exemplary. It will be seen that most of them have been chosen to give round numbers, or to conform to standard sizes, in the systems of building commonly used in the USA. The skilled reader will readily understand how they may be varied for specific implementations, and how they should be varied for conformity with the systems of measurement and standard building systems of other countries.

In the interests of clarity, the present stringer and decking system are described in a usual orientation. However, expressions of orientation should be interpreted purposively, and not too literally. In particular, it should not be assumed that a real deck is absolutely horizontal, and a deck may deliberately have a few degrees of slope to improve drainage. In addition, the stringers, boards, and joists may be shipped or stored in any orientation.

The invention claimed is:

1. A stringer for decking, comprising:

a strip of material having a lengthwise direction to extend along a top surface of a decking joist, and a widthwise direction to extend across the top surface of the decking joist; and a plurality of clips disposed along the strip, each clip having a base part standing up from the strip, and a head projecting lengthwise of the strip, alternate clips having their heads projecting in opposite directions;

wherein pairs of adjacent clips with their heads projecting towards each other are equally spaced and arranged to receive a grooved decking board with the heads of the clips in the grooves of the board;

wherein pairs of adjacent clips with their heads facing away from each other are equally spaced, at a spacing smaller than the spacing between pairs of adjacent clips with their heads projecting towards each other, and arranged to define a gap between adjacent decking boards; and wherein each clip comprises a back extending up from the strip, a top extending forward from the back, a front extending downward from the top, and a lip extending backward from the front above the strip.

2. The stringer according to claim 1, comprising at least twenty clips.

3. The stringer according to claim 1, wherein the clips are offset from a longitudinal centerline of the stringer in two rows, on either side of the centerline, and the clips in each row have their heads facing in the same direction.

4. The stringer according to claim 1, wherein the strip has flanges extending downwards along its side edges, to fit over sides of the decking joist.

5. The stringer according to claim 1, wherein the clips are formed by cutting flaps out of the metal strip, and bending the flaps to form the clips.

6. The stringer according to claim 1, wherein holes for nailing or screwing the stringer to the joist are provided between pairs of clips with their heads facing towards each other.

7. The stringer according to claim 1, in combination with a decking board having grooves along its narrow sides, and sized to fit between a pair of adjacent clips with their heads projecting towards each other with the heads of the clips in the grooves of the board.

8. The stringer according to claim 4, in combination with a decking joist that has a width to fit between the flanges.

* * * * *